US006128920A

United States Patent [19]

Matsuo et al.

[11] Patent Number: 6,128,920

[45] Date of Patent: Oct. 10, 2000

[54] DEPHLEGMATOR

[75] Inventors: Hitoshi Matsuo; Zbigniew Urban, both of Kurashiki; Masaaki Akamatsu; Masao Onaka, both of Takasago, all of Japan

[73] Assignee: Kabushiki Kaisha Kobe Seiko Sho, Kobe, Japan

[21] Appl. No.: 09/258,853

[22] Filed: Feb. 26, 1999

[30] Foreign Application Priority Data

Mar. 3, 1998 [JP] Japan ..... 10-050406

[51] Int. Cl.[7] ..... F25J 3/00

[52] U.S. Cl. ..... 62/627; 62/903; 165/166

[58] Field of Search ..... 62/627, 643, 903; 165/166

[56] References Cited

U.S. PATENT DOCUMENTS 5,144,809 9/1992 Chevalier et al. .
5,644,931 7/1997 Ueno et al. ..... 62/612
5,682,645 11/1997 Lehman ..... 165/111
5,802,871 9/1998 Howard et al. ..... 62/627
5,899,093 5/1999 Ha ..... 62/643

FOREIGN PATENT DOCUMENTS 767352 4/1997 European Pat. Off. .

*Primary Examiner*—William Doerrler
*Attorney, Agent, or Firm*—Reed Smith Hazel & Thomas LLP

[57] ABSTRACT

A dephlegmator includes a feed gas passage and a refrigerant passage. A feed gas introduced into the feed gas passage from the bottom is heat-exchanged with a refrigerant passing through the refrigerant passage. Components having low boiling points are withdrawn as rectified gases from the top, and components having high boiling points are discharged as condensates from the bottom. The refrigerant passage is divided into a first section on the top side and a second section on the bottom side by a bridgewall. In the first section, a liquid or gas-liquid two-phase refrigerant is introduced from the bottom of the refrigerant passage so as to flow parallel to the feed gas. In the second section, a gas fraction of the refrigerant discharged from the first section flows.

12 Claims, 11 Drawing Sheets

PRIOR ART

PRIOR ART

PRIOR ART

PRIOR ART

DEPHLEGMATOR

BACKGROUND OF THE INVENTION

1. Field of the Invention

The present invention relates to a dephlegmator which is mainly used as an alternative to a distillation apparatus in a low-temperature separation plant such as a natural gas liquefaction plant.

2. Description of the Related Art

A dephlegmator is provided with feed gas passages and refrigerant passages. A feed gas introduced into the feed gas passages from the bottom is partially condensed by a refrigerant that passes through the refrigerant passages, components having low boiling points are withdrawn as rectified gases from the top, and components having high boiling points are discharged as condensates from the bottom. This process is known as "rectification".

The dephlegmator is generally provided with a plate-fin exchanger in which passages are formed by alternately stacking corrugated heat-transfer fins and pass partition plates.

FIG. 9 is a partial sectional view of a core (a block of stacked heat-transfer fins and pass partition plates) C in the plate-fin exchanger, and FIG. 10 shows the passage arrangement of the core C.

In the drawing, numeral 1 represents a heat-transfer fin, numeral 2 represents a pass partition plate, and numeral 3 represents a side bar. A refrigerant passage 4 and a feed gas passage 5 are alternately formed between the individual pass partition plates 2.

A feed gas A flows, for example, from the bottom to the top through the feed gas passages 5, and a portion of the feed gas is condensed by means of heat exchange with a liquid or gas-liquid two-phase refrigerant B which passes through the refrigerant passages 4. A condensate AL is discharged from the bottom and a gas fraction (rectified gas) is discharged from the top.

In the plate-fin exchanger type dephlegmator, the following two structures are known with respect to a relationship between the flow direction of the refrigerant and that of the feed gas:

1. a structure, as shown in FIG. 11, in which the refrigerant flows downward from the top to the bottom of the core C and the feed gas flows upward from the bottom to the top, i.e., countercurrently (for example, refer to U.S. Pat. No. 4,002,042; hereinafter referred to as conventional art 1)
2. a structure, as shown in FIG. 12, in which the refrigerant flows upward from the middle section of the core C, in the same direction as that of the feed gas, i.e., in a parallel flow state (hereinafter referred to as conventional art 2)

The conventional arts 1 and 2, however, have drawbacks as described below.

DRAWBACK OF CONVENTIONAL ART 1

A dephlegmator includes a core C having distributors for introduction or discharge of a refrigerant and a feed gas.

The typical arrangement of distributors in the countercurrent type dephlegmator such as conventional art 1 is shown in FIG. 13.

In FIG. 13, feed gas side passages of the core C are shown on the left side and refrigerant side passages are shown on the right side.

On the bottom of a rectification section 6 on the feed gas side, a bottom distributor 7 for feed gas introduction and condensate discharge is provided, and on the top, a top distributor 8 for rectified gas discharge is provided On the top of an evaporation-heat exchange section 9 on the refrigerant side, a top distributor 10 for introducing a liquid or gas-liquid two-phase refrigerant is provided, and on the bottom, a bottom distributor 11 for discharging a gas refrigerant is provided.

Arrows in the drawing represent the direction of the individual fluids.

FIG. 14 shows a composite view of the top distributors 8 and 10. In the countercurrent type dephlegmator, heat exchange operation between the refrigerant and the feed gas takes place mainly in the top distributors 8 and 10. (In FIG. 14, the shaded portion shows a section in which the heat exchange operation takes place.)

That is, cold transfer from the refrigerant to the feed gas takes place mainly in the shaded portion in FIG. 14. The majority of the refrigerant is vaporized in the top distributor 10 and its cold is exhausted.

Therefore, transfer of the cold of the refrigerant from the refrigerant side to the feed gas side does not take place uniformly in the passage width direction, and unevenness of condensation of the feed gas easily occurs. As a result, components of the feed gas having high boiling points that should have been condensed ascend and pass through this section, resulting in a significant decrease in the rectification performance of the entire dephlegmator.

DRAWBACK OF CONVENTIONAL ART 2

In the parallel flow type dephlegmator such as conventional art 2 in which a refrigerant and a feed gas flow in the same direction, unevenness of condensation of the feed gas does not occur easily, unlike the countercurrent type dephlegmator described above.

Presumably, the reason for this is that since the refrigerant spreads in the width direction of a core C because of its weight, distribution unevenness of the refrigerant in the core width direction does not easily occur and transfer of the cold of the refrigerant to the feed gas takes place uniformly in the core width direction.

However, a problem with the conventional 2 is that a liquid or gas-liquid two-phase refrigerant is discharged once it passes through the passages, only the latent heat of the refrigerant is recovered, and the sensible heat is not recovered, and thus recovery of the cold of the refrigerant deteriorates, resulting in a decrease in the rectification performance.

SUMMARY OF THE INVENTION

Accordingly, it is an object of the present invention to provide a dephlegmator in which unevenness of condensation is prevented and not only the latent heat but also the sensible heat of the refrigerant is recovered, enabling improvement in rectification performance.

According to a first aspect of the present invention, a dephlegmator includes feed gas passages and refrigerant passages. By heat-exchanging a feed gas introduced into the feed gas passages from the bottom with a refrigerant passing through the refrigerant passages, components having low boiling points are withdrawn as rectified gases from the top, and components having high boiling points are discharged as condensates from the bottom. The refrigerant passages are divided into a first section on the top side and a second section on the bottom side by a bridgewall. In the first section, a liquid or gas-liquid two-phase refrigerant is introduced from the bottom of refrigerant passages so as to flow parallel to the feed gas, and in the second section, a gas fraction of the refrigerant discharged from the first section flows.

According to a second aspect of the present invention, preferably, the refrigerant is discharged from the top of the first section in a gas-liquid two-phase state, and the two-phase refrigerant is separated into a gas fraction and a liquid fraction by a gas-liquid separator, and then the gas fraction is fed to the second section and the liquid fraction is fed to the first section.

According to a third aspect of the present invention, preferably, in the second section, the gas fraction of the refrigerant flows downward so as to be a countercurrent to the feed gas.

According to a fourth aspect of the present invention, preferably, the bridgewall is inclined in relation to the axis orthogonal to the refrigerant flow direction, upper and lower inlet-outlet ends of the refrigerant of the first and second sections, respectively, are provided so as to sandwich the bridgewall. Alternatively, according to a fifth aspect of the present invention, preferably, an inlet and an outlet of the refrigerant in each of the first and second sections are provided on both sides of a direction orthogonal to the refrigerant flow so that either introduction or discharge of the refrigerant is performed from both sides of the direction orthogonal to the refrigerant flow in the first and second sections.

As described above, since a liquid or gas-liquid two-phase refrigerant flows in the same direction as that of the feed gas (parallel flow) in the first section, unevenness of condensation does not easily occur.

Additionally, since the gas refrigerant discharged from the first section is fed to the second section, both the latent heat and the sensible heat of the refrigerant are recovered, resulting in an increase in the recovery of the cold of the refrigerant.

In these respects, the rectification performance of the entire dephlegmator can be improved.

In such a case, in accordance with the second aspect of the present invention, since the refrigerant is separated into a gas fraction and a liquid fraction by a gas-liquid separator, and then the liquid fraction is fed to the first section and the gas fraction is fed to the second section, the gas refrigerant and the liquid refrigerant can be maintained at the same temperature.

In accordance with the third aspect of the present invention, since the gas refrigerant flows countercurrently in relation to the feed gas, that is, heat exchange takes place between countercurrent gases, heat exchange efficiency can be improved.

In accordance with the fourth aspect of the present invention, the length of the middle section of the refrigerant inlets or outlets can be reduced, and thereby, the core length can be reduced.

In accordance with the fifth aspect of the present invention, since the introduction and discharge of the refrigerant are performed on both sides of the core, pressure loss of the refrigerant at the inlets or outlets can be reduced.

DESCRIPTION OF THE PREFERRED EMBODIMENTS

Figure 1:
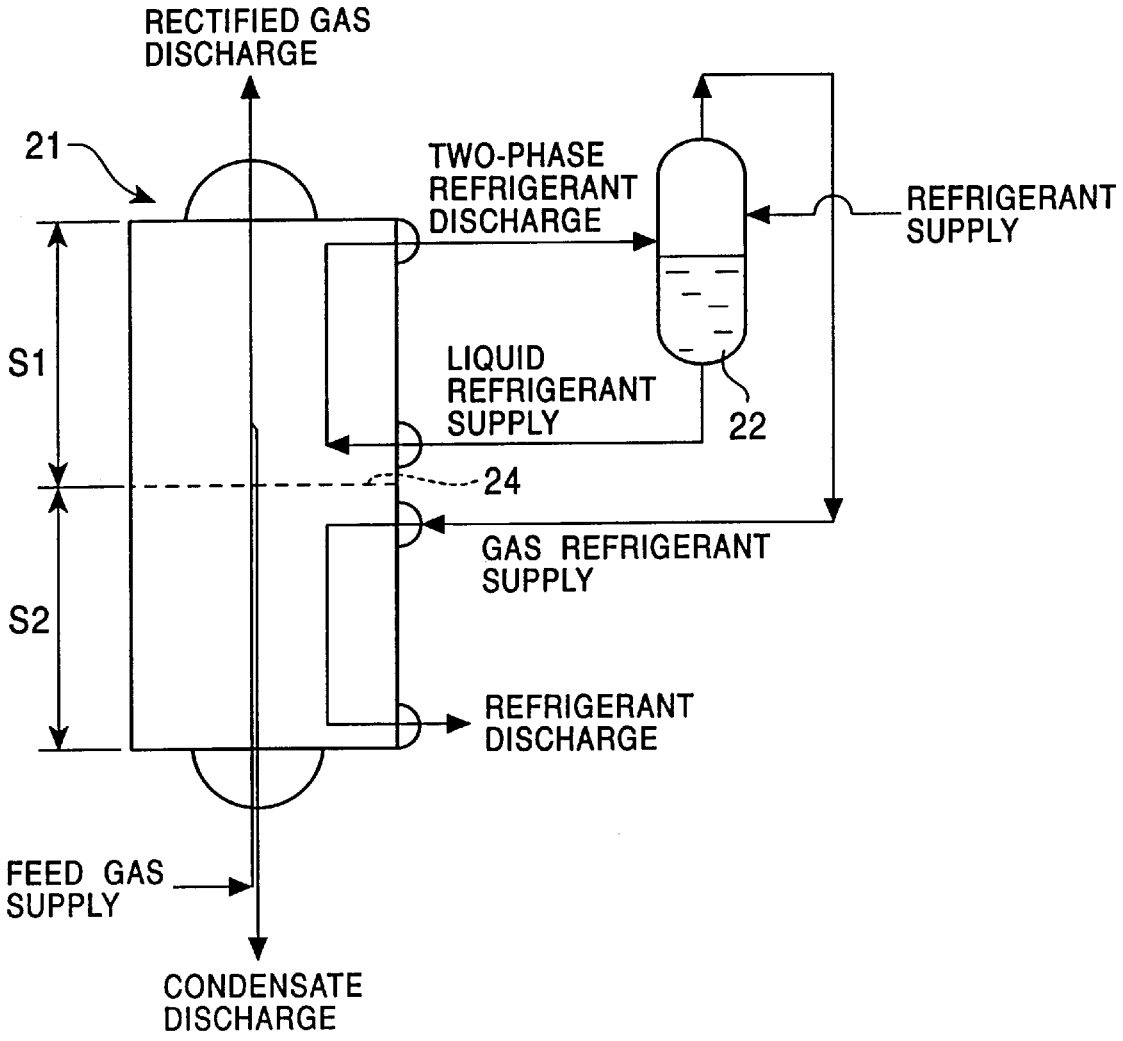
FIG. 1 is a flow sheet which shows a relationship between the feed gas flow and the refrigerant flow in accordance with a first embodiment of the present invention.

First Embodiment (Refer to FIGS. 1 through 6)

A dephlegmator in accordance with this embodiment includes a dephlegmator body 21 provided with feed gas passages and refrigerant passages and a gas-liquid separator 22 for separating a refrigerant into a gas fraction and a liquid fraction.

The body 21 includes a core 23 having a structure of a plate-fin exchanger in which corrugated heat-transfer fins and pass partition plates are stacked to form a block, and the refrigerant passage side in the core 23 is divided into an upper first section S1 and a lower second section S2 by a bridgewall 24.

Figure 2:
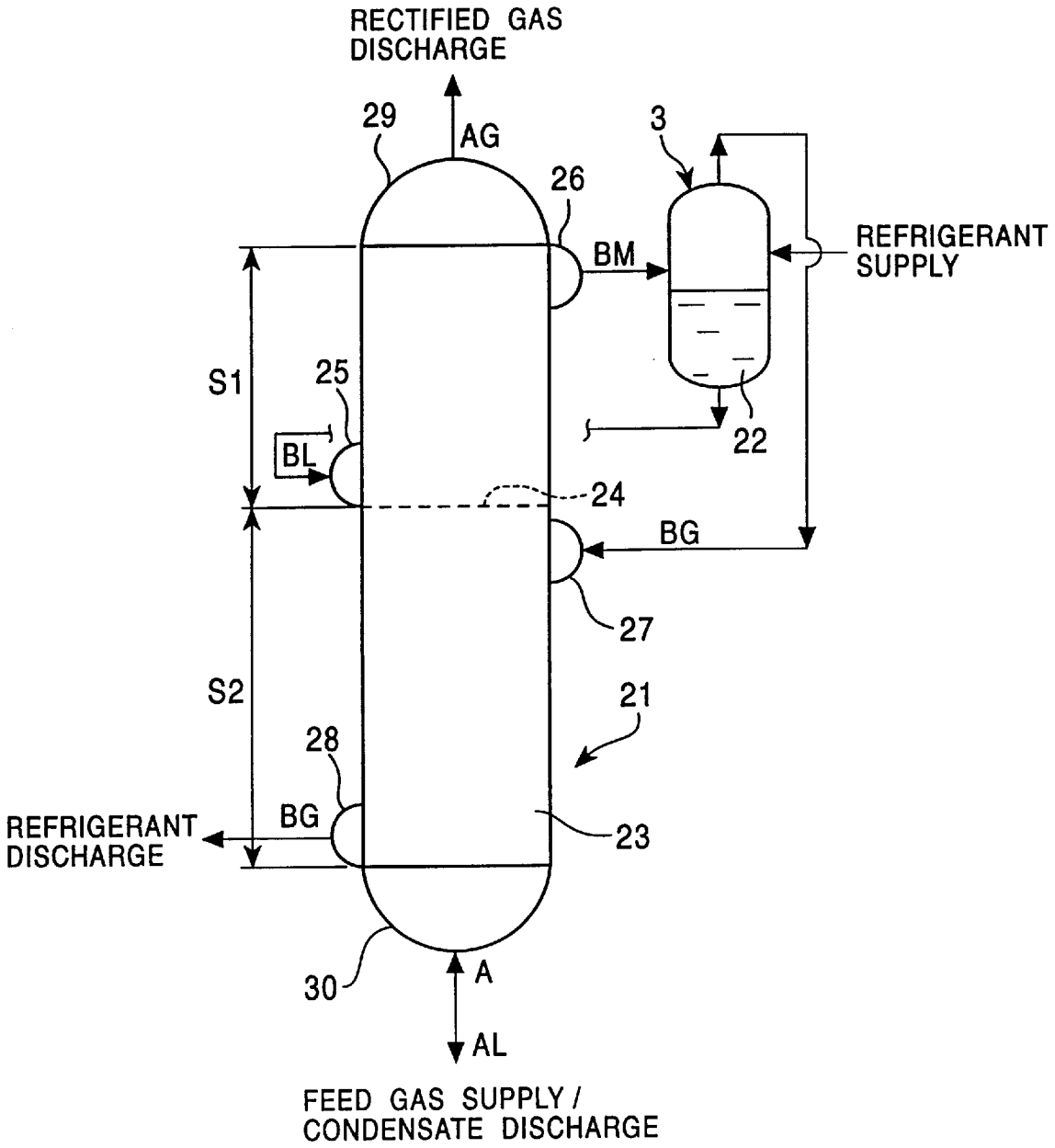
FIG. 2 is a schematic diagram of the first embodiment.
Figure 3:
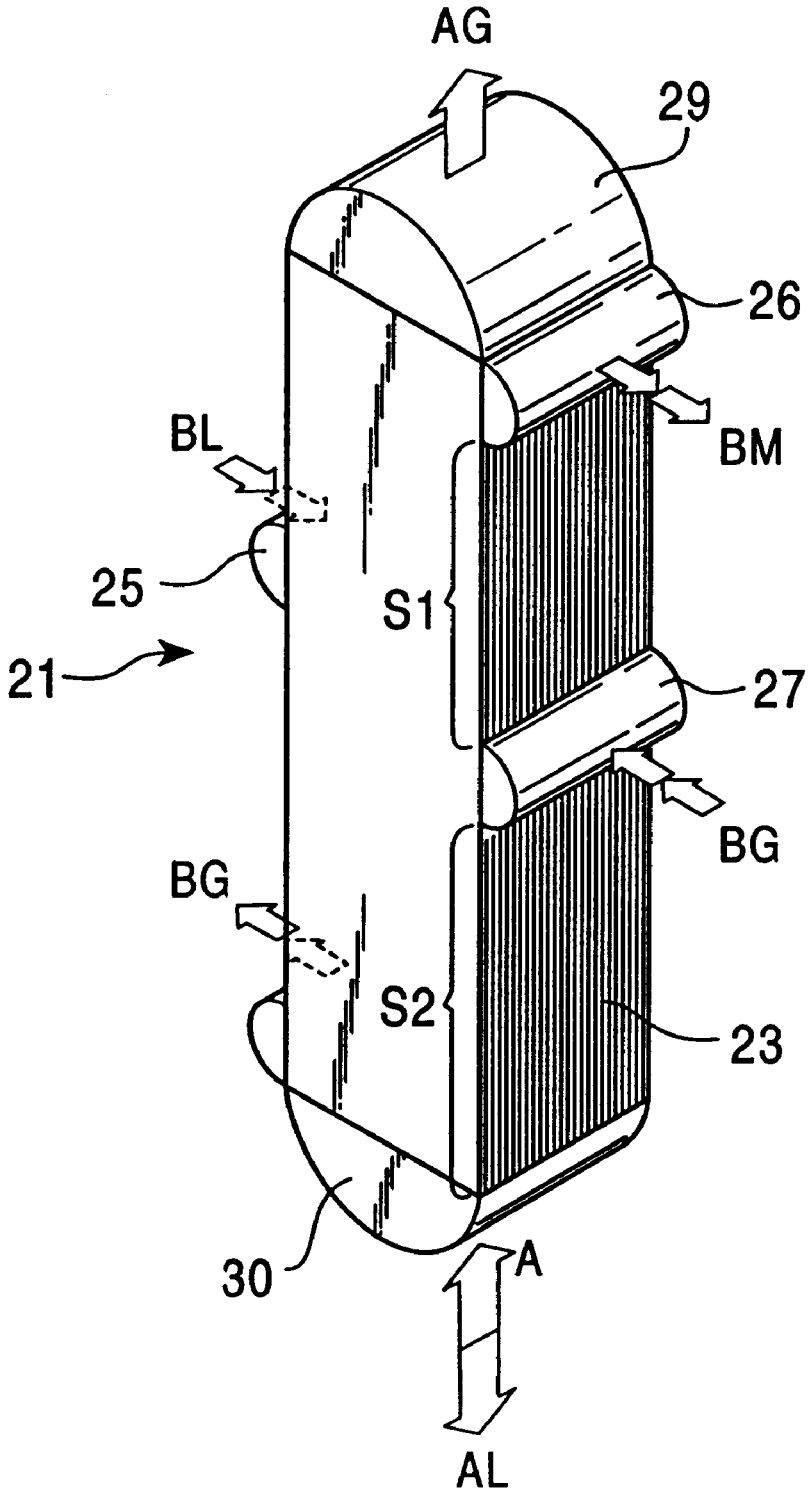
FIG. 3 is a perspective view of a dephlegmator in accordance with the first embodiment.
Figure 4:
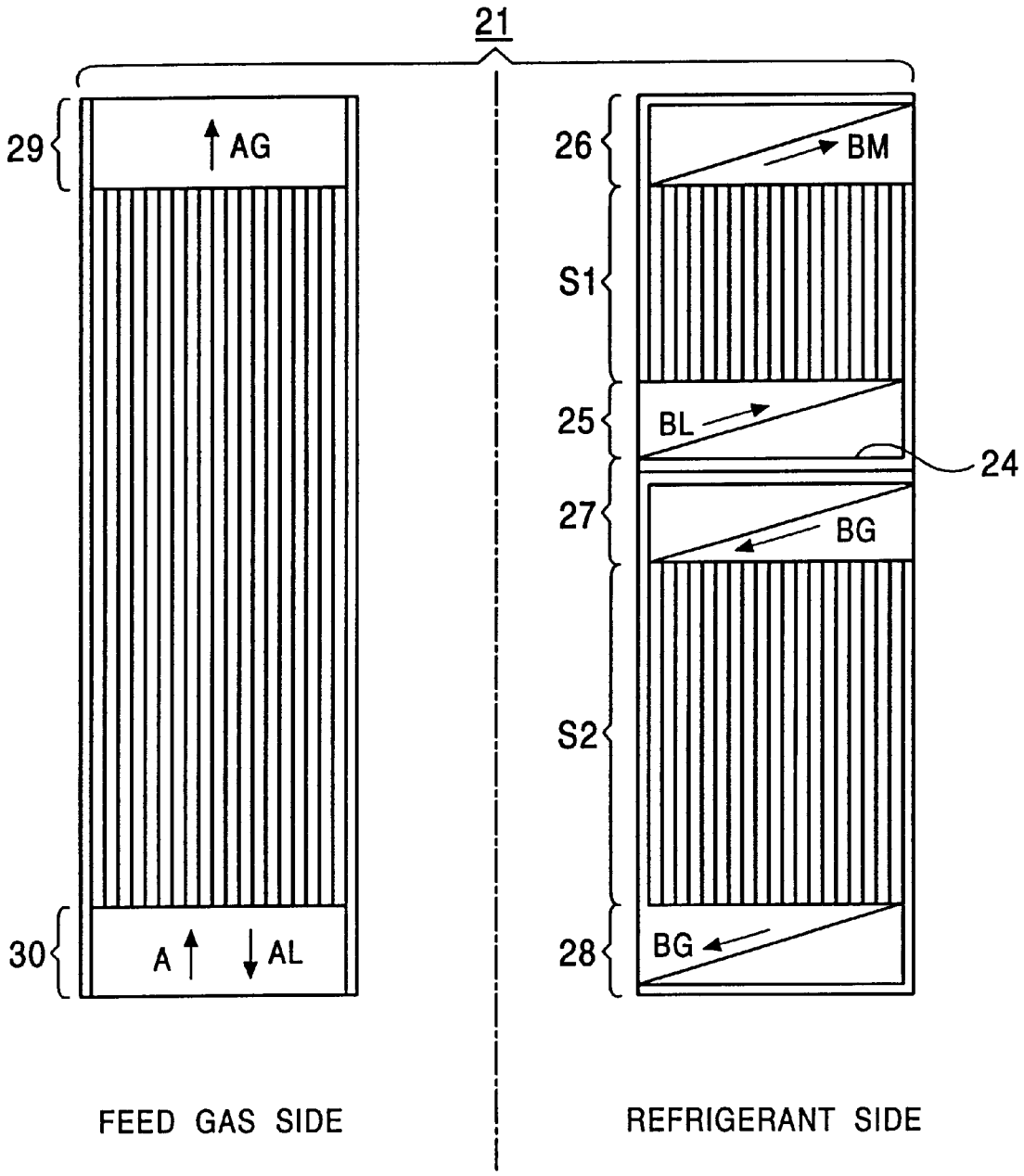
FIG. 4 is a diagram which separately shows the passages of the feed gas side and the refrigerant side of the dephlegmator shown in FIG. 3.

The first section S1 is provided with a distributor 25 for liquid refrigerant introduction in the lower part (above the bridgewall 24) and a distributor 26 for refrigerant discharge in the upper part, as shown in FIGS. 2 through 4.

The second section S2 is provided with a distributor 27 for gas refrigerant introduction in the upper part (below the bridgewall 24) and a distributor 28 for gas refrigerant discharge in the lower part.

Passages in the feed gas side are continuously formed from the bottom to the top, and a distributor 29 for rectified gas discharge is provided on the top and a distributor 30 for feed gas introduction and condensate discharge is provided on the bottom.

A liquid refrigerant BL is introduced into the first section S1 of refrigerant passages through the distributor 25 for refrigerant introduction and flows upward parallel to a feed gas A to transfer cold to the feed gas A.

Thereby, components having high boiling points in the feed gas A are condensed and discharged from the bottom through the distributor 30 for condensate discharge, and components having low boiling points are discharged from the top as rectified gases AG through the distributor 29 for rectified gas discharge.

The liquid refrigerant BL is partially vaporized due to heat from the feed gas and the gas-liquid two-phase refrigerant is discharged from the distributor 26 for refrigerant discharge.

The discharged refrigerant is fed to the gas-liquid separator 22 and is separated into a gas fraction BG and a liquid fraction BL. The liquid fraction BL together with a liquid refrigerant supplied from a liquid refrigerant source (not shown in the drawing) is fed to the first section S1 through the distributor 25 for refrigerant introduction.

The gas-liquid two-phase refrigerant circulates between the dephlegmator body 21 and the gas-liquid separator 22 by a thermosiphon effect based on the difference in density of the refrigerants on the inlet side and on the outlet side.

The gas fraction BG separated in the gas-liquid separator 22 is discharged from the top of the separator, is introduced into the second section S2 through the distributor 27 for gas refrigerant introduction, and flows downward, in the direction opposite to the feed gas A, to transfer cold to the feed gas A.

The gas refrigerant BG is heated and is discharged from the second section S2 through the distributor 28 for gas refrigerant discharge.

As described above, since the passages in the refrigerant side is divided into the first section S1 and the second section S2 and in the first section S1 the liquid refrigerant BL flows in the direction same as the feed gas A (parallel flow), unevenness of condensation of the feed gas does not easily occur.

Additionally, since the latent heat of the liquid refrigerant BL is recovered in the first section S1 and then the gas fraction BG of the gas-liquid two-phase refrigerant BM discharged from the first section S1 is fed into the second section S2 to transfer its sensible heat to the feed gas A, both the latent heat and the sensible heat of the refrigerant are recovered, resulting in an increase in the recovery of the cold of the refrigerant.

Moreover, since the gas-liquid two-phase refrigerant BM is separated into gas and liquid by the gas-liquid separator 22 and then the liquid fraction BL is fed to the first section S1 and the gas fraction BG is fed to the second section S2, the gas refrigerant BG and the liquid refrigerant BL can be maintained at the same temperature.

Additionally, since the gas refrigerant BG flows downward, in the direction opposite to the feed gas A, and heat exchange takes place between countercurrent gases BG and A in the second section S2, heat exchange efficiency can be improved.

Figure 5:
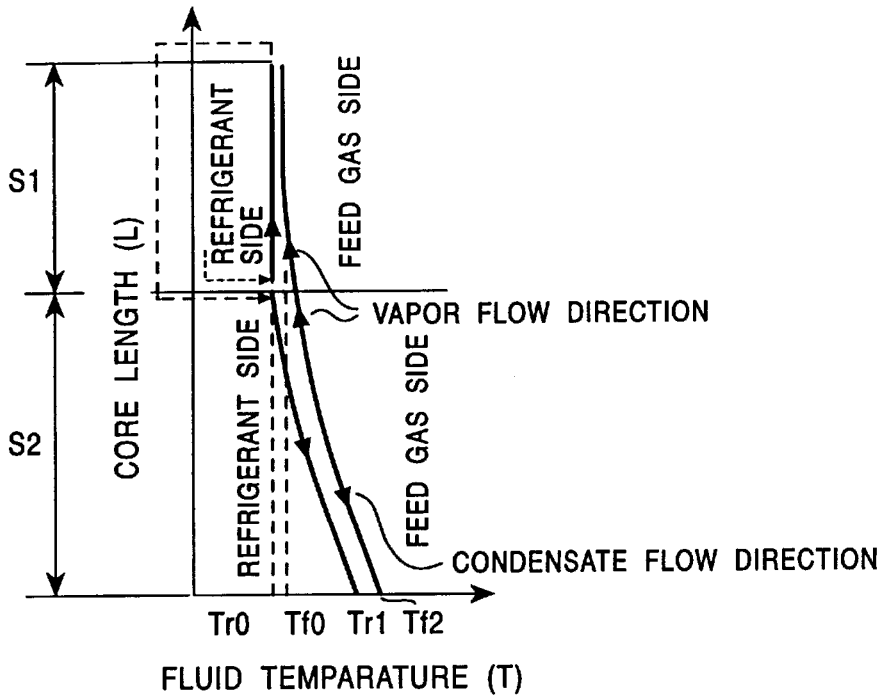
FIG. 5 is a diagram which shows a fluid temperature profile in the core lengthwise direction in accordance with the first embodiment.
Figure 6:
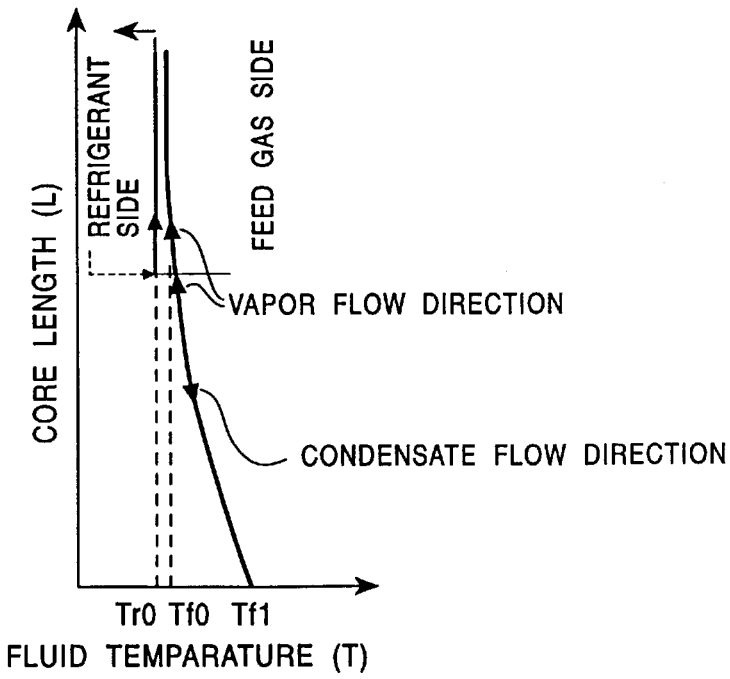
FIG. 6 is a diagram which shows a fluid temperature profile in the core lengthwise direction in accordance with a conventional art 2 shown in FIG. 12.
Figure 12:
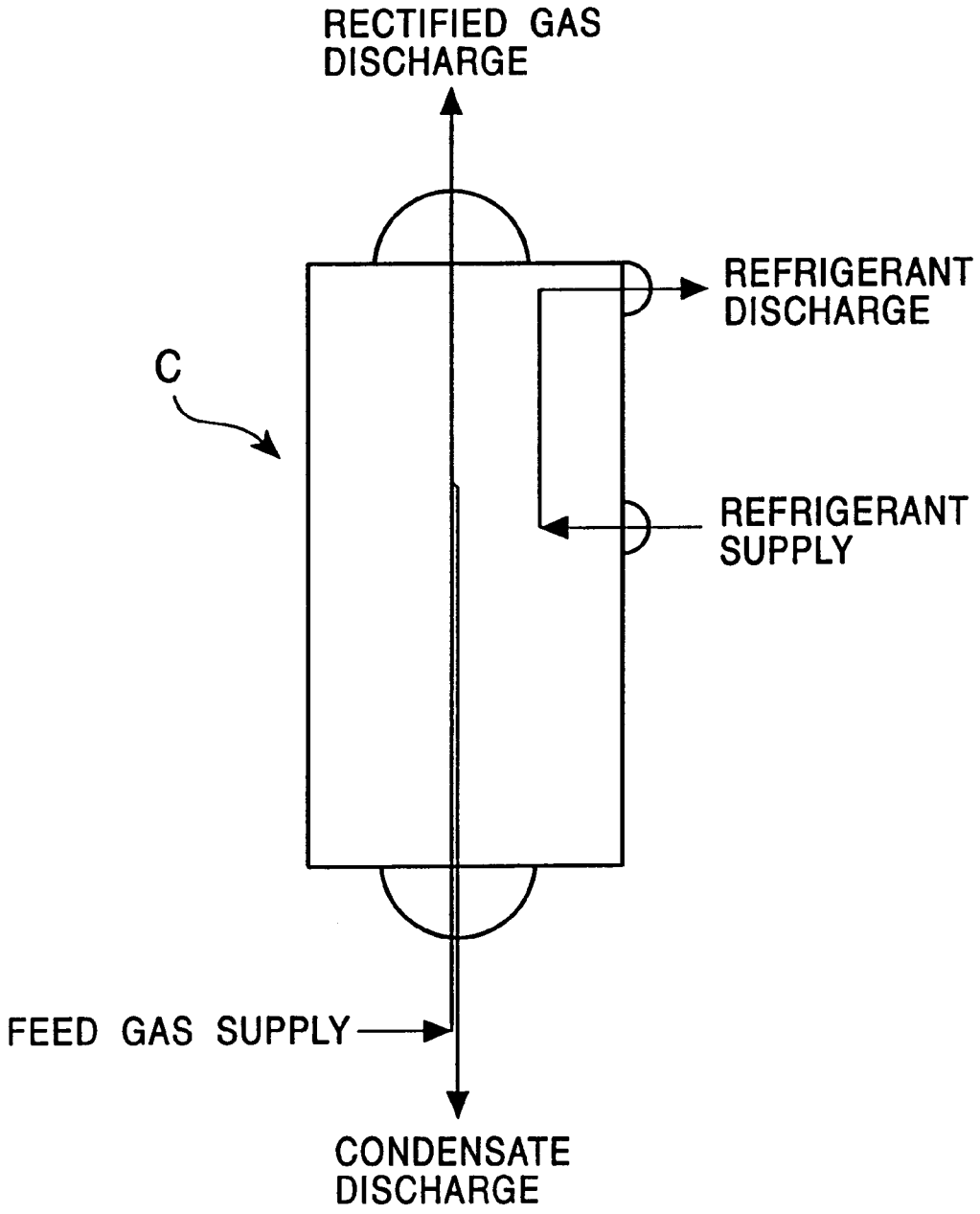
FIG. 12 is a flow sheet which shows a relationship between the feed gas flow and the refrigerant flow in accordance with a conventional art 2.
Figure 13:
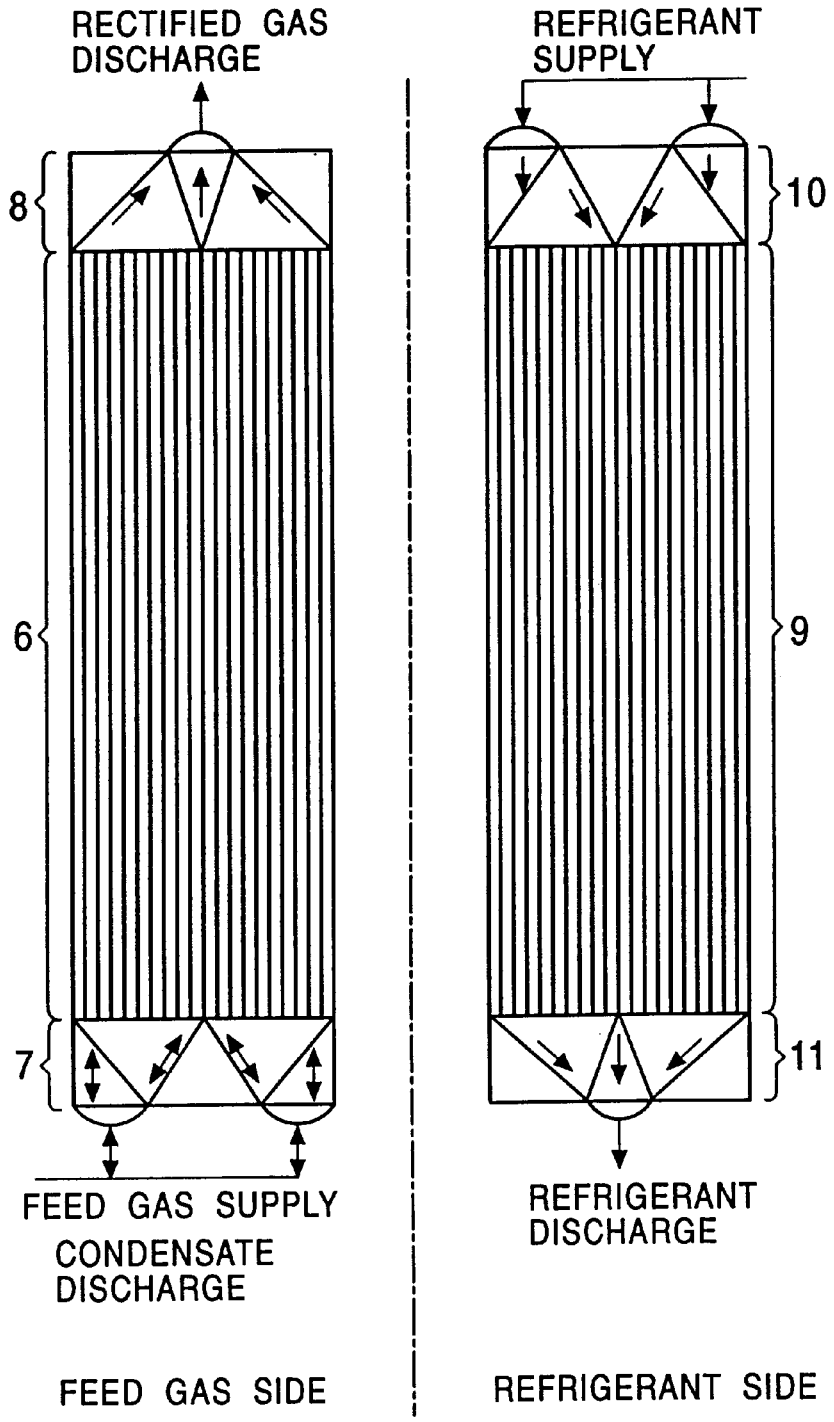
FIG. 13 is a diagram which separately shows the passages of the feed gas side and the refrigerant side of a dephlegmator in accordance with the conventional art 1.
Figure 14:
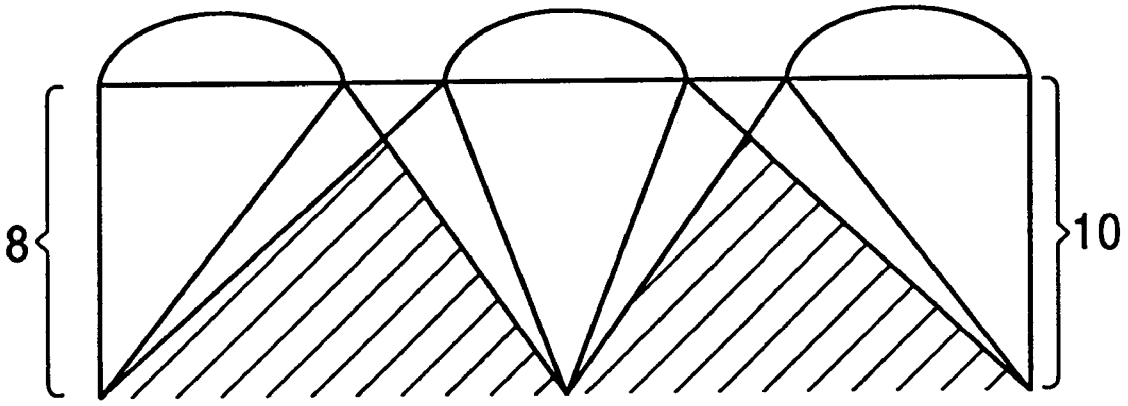
FIG. 14 is a composite view of the top distributors on the feed gas side and on the refrigerant side in accordance with the conventional art 1.

FIG. 5 is a diagram which shows a fluid temperature profile in the core lengthwise direction in the dephlegmator body 21 of this embodiment. FIG. 6 is a diagram which shows a fluid temperature profile in the core lengthwise direction in the dephlegmator in accordance with the conventional art 2 shown in FIG. 12.

In the conventional art 2, since only the latent heat of the cold of the refrigerant is transferred to the feed gas side, the refrigerant is discharged with a temperature Tr0 being not raised.

In contrast, in accordance with the embodiment of the present invention, although the refrigerant is discharged from the first section S1 at the same temperature Tr0 as that of the conventional art 2, since the sensible heat is transferred to the feed gas side in the second section S2, the final temperature is raised to Tr1.

With respect to the feed gas, in the conventional art 2, the feed gas introduced at a temperature Tf1 is partially condensed due to the cold of the refrigerant and is discharged as a rectified gas at a temperature Tf0.

On the contrary, in accordance with the embodiment of the present invention, even if the feed gas is introduced at a temperature Tf2 that is higher than the temperature Tf1, the feed gas can be discharged as a rectified gas at the temperature Tf0 which is the same as that in the conventional art 2. That is, the introduction of the feed gas can be set at a higher temperature in comparison with the conventional art 2.

Figure 7:
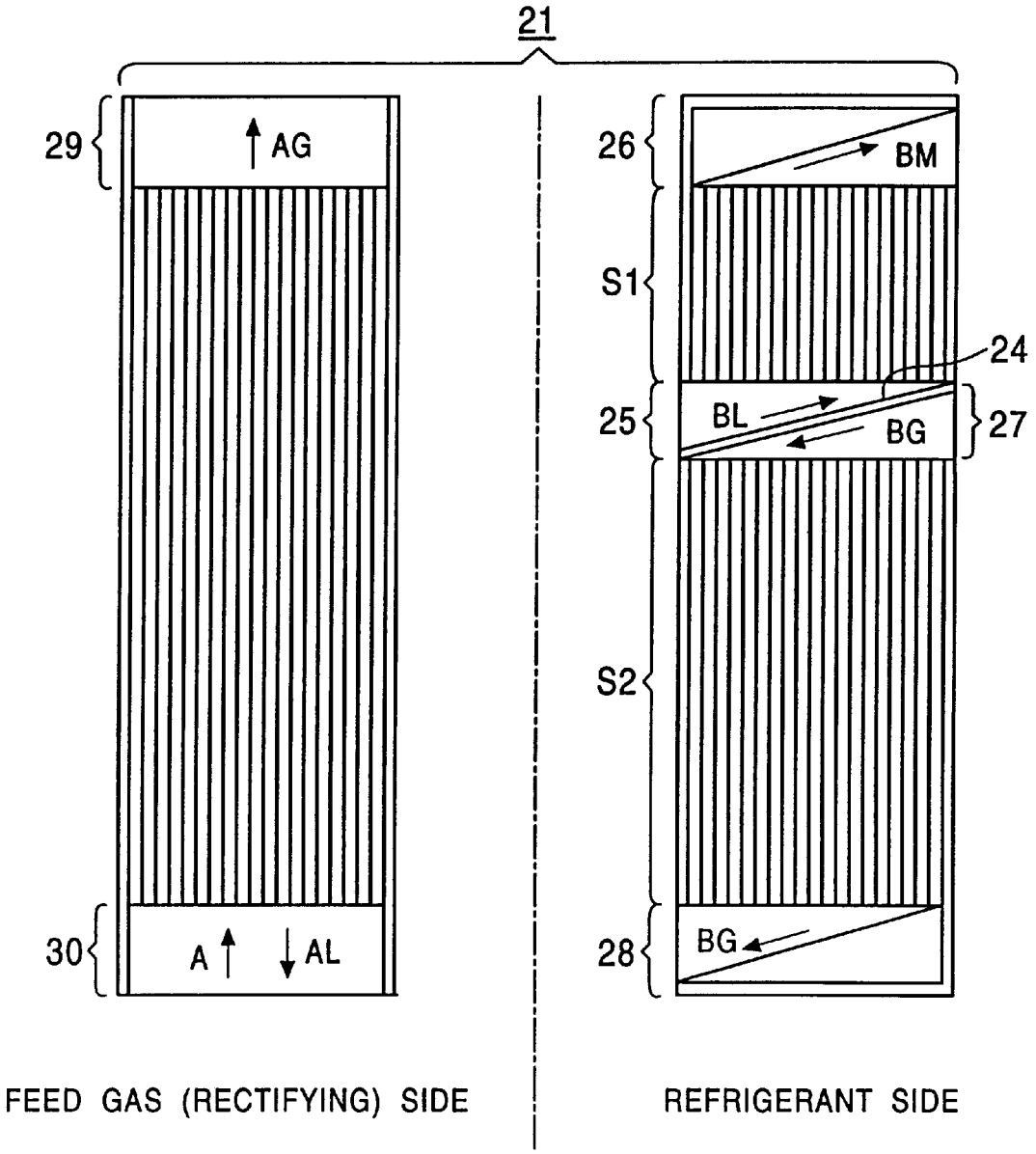
FIG. 7 is a diagram which separately shows the passages of the feed gas side and the refrigerant side of a dephlegmator body in accordance with a second embodiment of the present invention.
Figure 8:
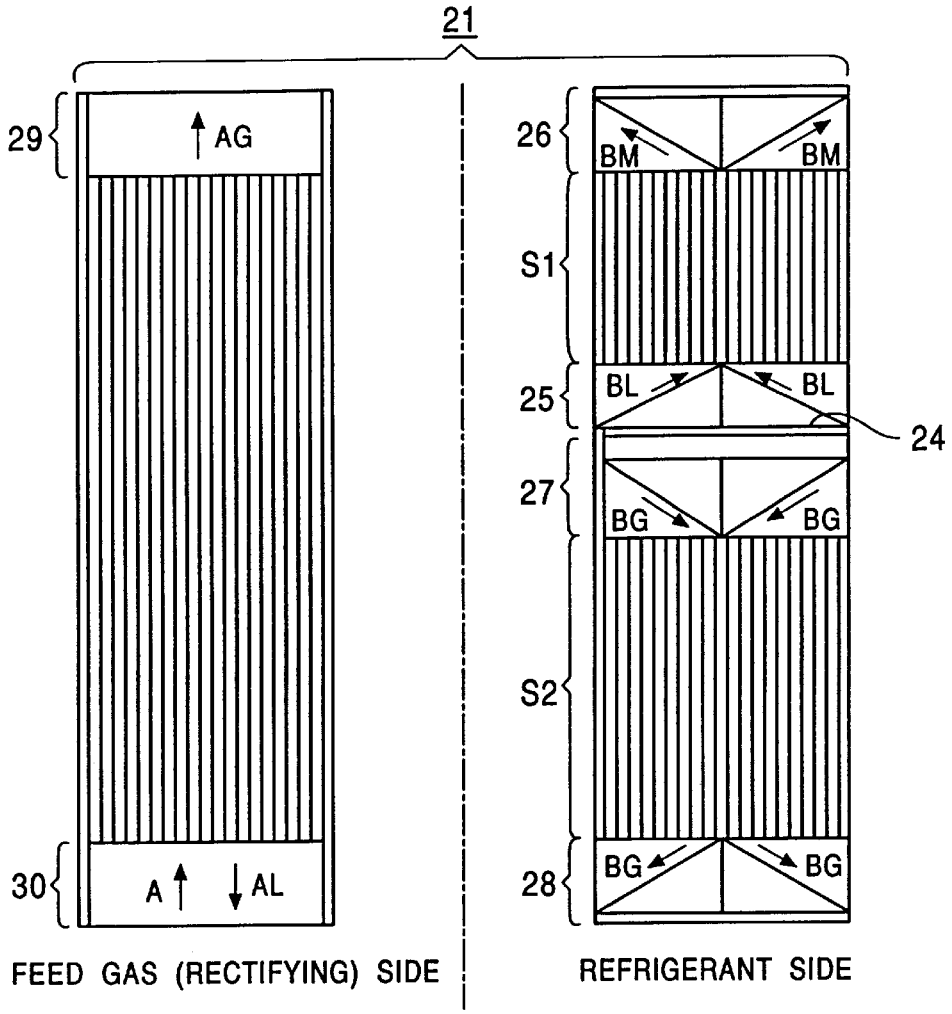
FIG. 8 is a diagram which separately shows the passages of the feed gas side and the refrigerant side of a dephlegmator body in accordance with a third embodiment of the present invention.
Figure 9:
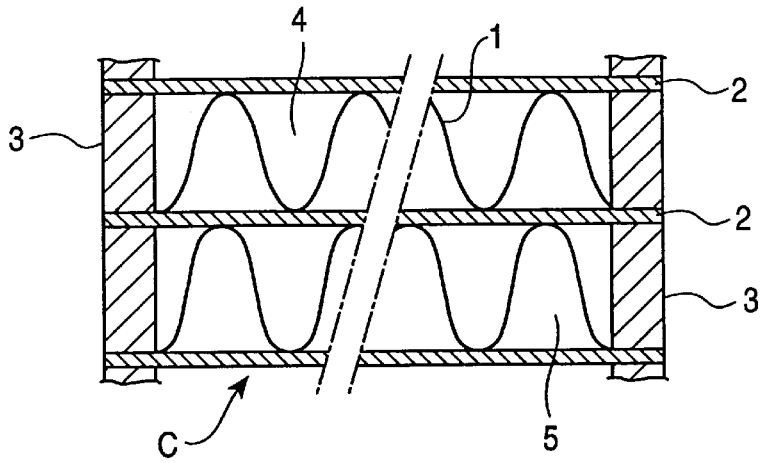
FIG. 9 is a partial sectional view of a plate-fin exchanger type dephlegmator.
Figure 10:
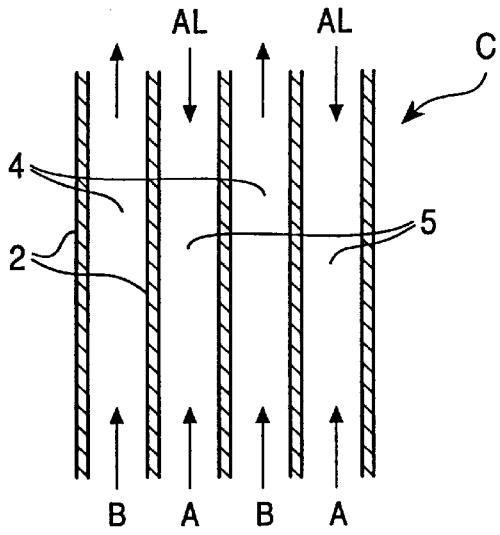
FIG. 10 is a diagram which shows the passage arrangement of the dephlegmator shown in FIG. 9.
Figure 11:
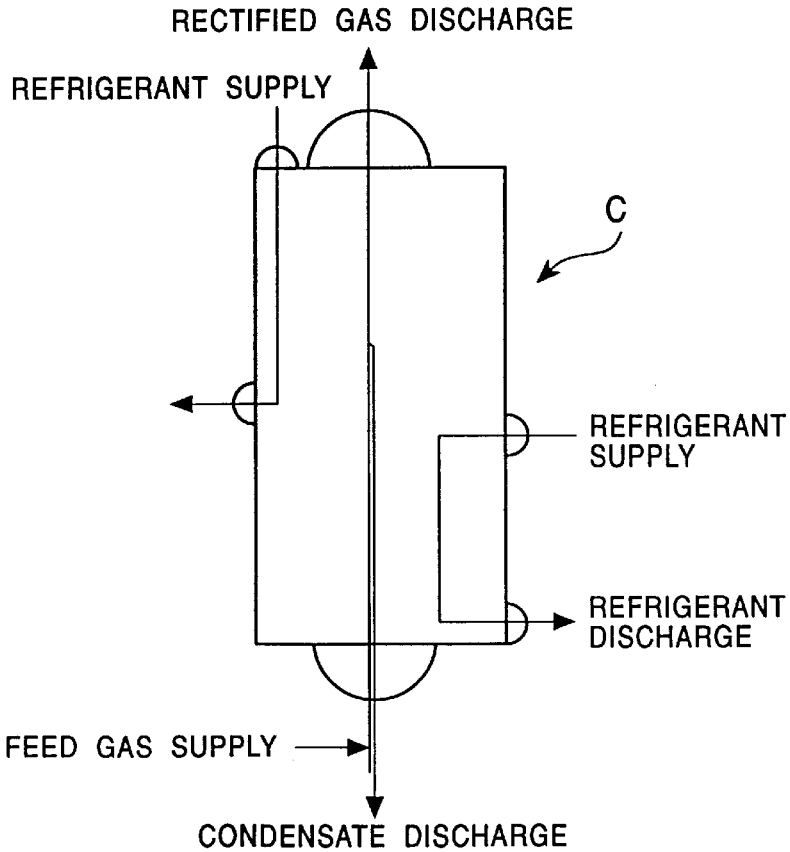
FIG. 11 is a flow sheet which shows a relationship between the feed gas flow and the refrigerant flow in accordance with a conventional art 1.

Second and Third Embodiments (Refer to FIGS. 7 and 8)

With respect to these embodiments, differences from the first embodiment alone will be described.

In the second and third embodiments, although the basic flows of the feed gas and the refrigerant are the same as those in the first embodiment, the structure of distributors in the middle of the refrigerant side is different from that in the first embodiment.

That is, in the second embodiment shown in FIG. 7, a bridgewall 24 is inclined in relation to the axis orthogonal to the refrigerant flow direction. A distributor 25 for liquid refrigerant introduction in the first section S1 is formed above the bridgewall 24, and a distributor 27 for gas refrigerant introduction in the second section S2 is formed below the bridgewall 24 adjacent to the distributor 25, and each distributor is formed so as to have a right triangular cross section with the bridgewall 24 as a hypotenuse.

In such a manner, the length of the distributor section in the middle of the core can be reduced in comparison with the first embodiment, and thus the core length can be reduced.

On the other hand, in the third embodiment shown in FIG. 8, all distributors 25, 26, 27, and 28 in the refrigerant side are provided on both sides of the core symmetrically in the direction orthogonal to the refrigerant flow.

In such a manner, the introduction and discharge of the refrigerant are performed on both sides of the core in the direction orthogonal to the refrigerant flow, and thus the pressure loss of the refrigerant at the individual distributors 25, 26, 27, and 28 can be decreased.

Other Embodiments (1) In the above embodiments, although the liquid refrigerant introduced into the first section S1 is discharged in the gas-liquid two-phase state and is separated by the gas-liquid separator 22 into gas and liquid, and then the liquid fraction is fed to the first section S1 and the gas fraction is fed to the second section S2, the entire liquid refrigerant introduced into the first section S1 may be vaporized and discharged in the gas phase and be fed to the second section S2.

(2) In the above embodiments, although the gas refrigerant is introduced into the second section S2 from the top and is discharged from the bottom, the gas refrigerant may be introduced from the bottom and be discharged from the top to flow parallel to the feed gas and be discharged from the top.

As described above, in accordance with the present invention, since refrigerant passages are divided into the upper first section and the lower second section and a liquid or gas-liquid two-phase refrigerant flows in the same direction as that of the feed gas (parallel flow) in the first section, unevenness of condensation of the feed gas does not easily occur.

Additionally, since the gas refrigerant discharged from the first section is fed to the second section, both the latent heat and the sensible heat of the refrigerant are recovered, resulting in an increase in the recovery of the cold of the refrigerant.

In these respects, the rectification performance and the refrigerant cold recovery efficiency of the entire dephlegmator can be improved.

In such a case, in accordance with the second aspect of the present invention, since the refrigerant is separated into a gas fraction and a liquid fraction by a gas-liquid separator, and then the liquid fraction is fed to the first section and the gas fraction is fed to the second section, the gas refrigerant and the liquid refrigerant can be maintained at the same temperature.

In accordance with the third aspect of the present invention, since the gas refrigerant flows countercurrently in relation to the feed gas, that is, heat exchange takes place between countercurrent gases, heat exchange efficiency can be improved.

In accordance with the fourth aspect of the present invention, the length of the middle section of the refrigerant inlets or outlets can be reduced, and thereby, the core length can be reduced.

In accordance with the fifth aspect of the present invention, since the introduction and discharge of the refrigerant are performed on both sides of the core, pressure loss of the refrigerant at the inlets or outlets can be reduced.

What is claimed is:

1. A dephlegmator comprising:

a feed gas passage; and a refrigerant passage, a feed gas introduced into said feed gas passage from the bottom being heat-exchanged with a refrigerant passing through said refrigerant passage, components having low boiling points being withdrawn as rectified gases from the top, and components having high boiling points being discharged as condensates from the bottom;

wherein said refrigerant passage is divided into a first section on the top side and a second section on the bottom side by a bridgewall;

in the first section, a liquid or gas-liquid two-phase refrigerant is introduced from the bottom of said refrigerant passage so as to flow parallel to the feed gas; and in the second section, a gas fraction of the refrigerant discharged from the first section flows.

2. A dephlegmator according to claim 1, wherein the refrigerant is discharged from the top of the first section in a gas-liquid two-phase state, and the two-phase refrigerant is separated into a gas fraction and a liquid fraction by a gas-liquid separator, and then the gas fraction is fed to the second section and the liquid fraction is fed to the first section.

3. A dephlegmator according to claim 1, wherein in the second section, the gas fraction of the refrigerant flows downward countercurrently to the feed gas.

4. A dephlegmator according to claim 1, wherein the bridgewall is inclined in relation to the axis orthogonal to the refrigerant flow direction, and one of an inlet and an outlet of the refrigerant in the first section and one of an inlet and an outlet of the refrigerant in the second section are formed adjacently with the bridgewall therebetween.

5. A dephlegmator according to claim 1, wherein an inlet and an outlet of the refrigerant in each of the first and second sections are provided on both sides of a direction orthogonal to the refrigerant flow so that one of introduction and discharge of the refrigerant is performed from both sides of the direction orthogonal to the refrigerant flow in the first and second sections.

6. A dephlegmator according to claim 2, wherein in the second section, the gas fraction of the refrigerant flows downward countercurrently to the feed gas.

7. A dephlegmator according to claim 2, wherein the bridgewall is inclined in relation to the axis orthogonal to the refrigerant flow direction, and one of an inlet and an outlet of the refrigerant in the first section and one of an inlet and an outlet of the refrigerant in the second section are formed adjacently with the bridgewall therebetween.

8. A dephlegmator according to claim 3, wherein the bridgewall is inclined in relation to the axis orthogonal to the refrigerant flow direction, and one of an inlet and an outlet of the refrigerant in the first section and one of an inlet and an outlet of the refrigerant in the second section are formed adjacently with the bridgewall therebetween.

9. A dephlegmator according to claim 6, wherein the bridgewall is inclined in relation to the axis orthogonal to the refrigerant flow direction, and one of an inlet and an outlet of the refrigerant in the first section and one of an inlet and an outlet of the refrigerant in the second section are formed adjacently with the bridgewall therebetween.

10. A dephlegmator according to claim 2, wherein an inlet and an outlet of the refrigerant in each of the first and second sections are provided on both sides of a direction orthogonal to the refrigerant flow so that one of introduction and discharge of the refrigerant is performed from both sides of the direction orthogonal to the refrigerant flow in the first and second sections.

11. A dephlegmator according to claim 3, wherein an inlet and an outlet of the refrigerant in each of the first and second sections are provided on both sides of a direction orthogonal to the refrigerant flow so that one of introduction and discharge of the refrigerant is performed from both sides of the direction orthogonal to the refrigerant flow in the first and second sections.

12. A dephlegmator according to claim 6, wherein an inlet and an outlet of the refrigerant in each of the first and second sections are provided on both sides of a direction orthogonal to the refrigerant flow so that one of introduction and discharge of the refrigerant is performed from both sides of the direction orthogonal to the refrigerant flow in the first and second sections.

* * * * *